United States Patent [19]

Woodring

[11] 4,083,306

[45] Apr. 11, 1978

[54] NOVEL CARTRIDGE

[75] Inventor: William B. Woodring, Stony Creek, Conn.

[73] Assignee: Olin Corporation, New Haven, Conn.

[21] Appl. No.: 148,102

[22] Filed: Oct. 27, 1961

[51] Int. Cl.[2] ..... F42B 5/02

[52] U.S. Cl. ..... 102/38; 102/93; 102/DIG. 7

[58] Field of Search ..... 102/93, 94, 38

[56] References Cited

U.S. PATENT DOCUMENTS

| | | | |
|---|---|---|---|
| 2,033,116 | 5/1962 | Critchee et al. | 102/93 |
| 2,663,259 | 12/1953 | Catlin et al. | 102/38 |
| 3,005,408 | 10/1961 | Prosen et al. | 102/93 |

*Primary Examiner*—Harold Tudor
*Attorney, Agent, or Firm*—William W. Jones; Paul J. Lerner

EXEMPLARY CLAIM

1. A flechette cartridge comprising an external cartridge casing, an internal flechette projectile having protruding stabilizing surfaces, a plurality of individual sabot segments encompassing said projectile and intermeshing with the said protruding stabilizing surfaces to align said projectile with the bore of the firearm in which said cartridge is fired, said projectile-sabot segmented unit having an axial length greater than the axial length of the protruding stabilizing surfaces on said projectile thus supporting the forward portion of the projectile against buckling as the unit proceeds down the bore of the firearm, said sabot segments when intermeshed with said projectile forming a circle of diameter equal to or greater than the diametric circle encompassing the said protruding stabilizing surfaces, explosive means to propel said projectile and suitable means to support said projectile and segmented sabots against thrust of the powder gases and to obturate said powder gases.

5 Claims, 6 Drawing Figures

FIG - 1
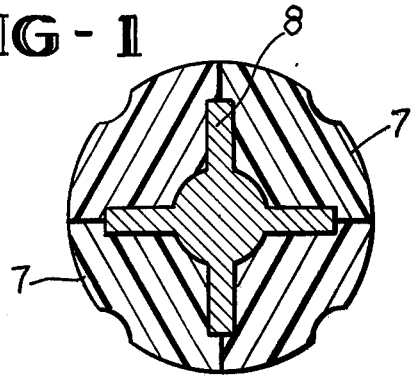
FIG - 2
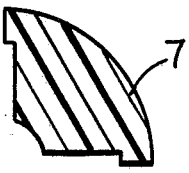
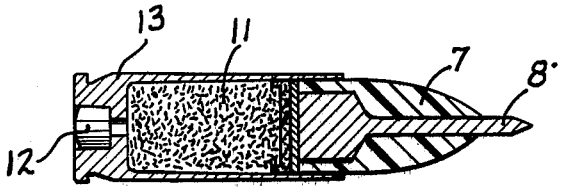
FIG - 6
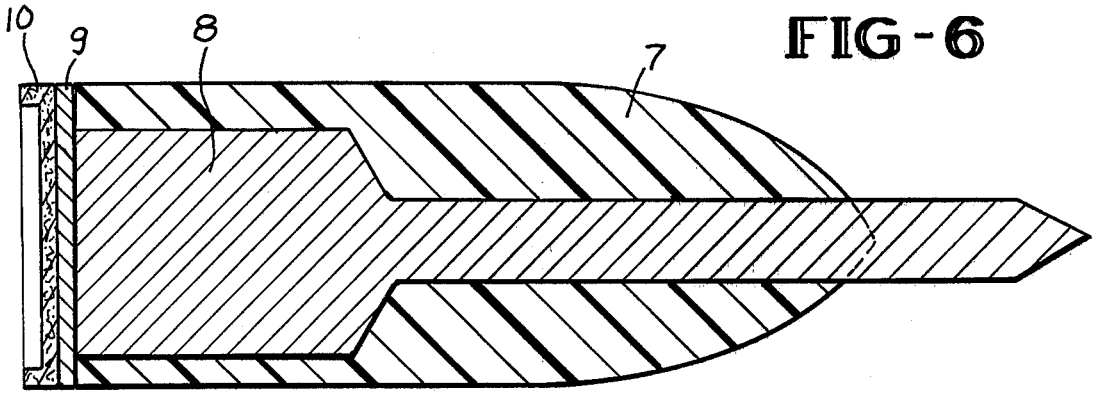
FIG - 3
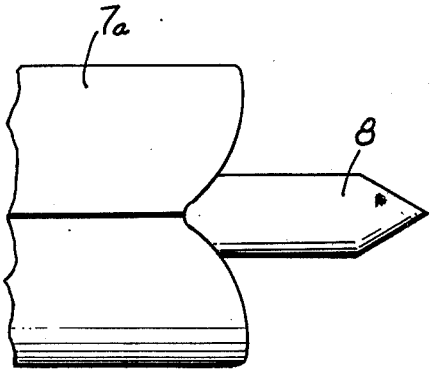
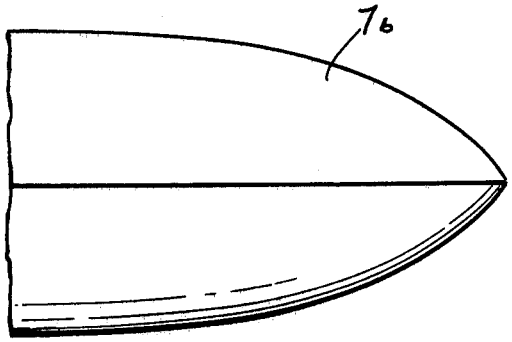
FIG - 4
FIG - 5

NOVEL CARTRIDGE

This invention relates to a so-called flechette cartridge and more particularly to a cartridge containing an internal needle-like finned flechette encompassed by a segmented sabot.

Within the ammunition field, there has always been an awareness of the need for projectiles which can be propelled at extremely high velocities. Currently there has been a surge of interest in the use of flechette type projectiles to attain these very high velocities. The flechette projectiles are invariably much smaller than the more conventional projectiles, and they may occur in a variety of forms although dart shaped or needle-like projectiles are most commonly encountered. The reduced weight of these tiny projectiles theoretically is the reason why they can be propelled at a much higher velocity than a heavier conventional projectile when comparable powder charges are employed.

However there have been significant disadvantages associated with the firing of these light weight flechette projectiles. For example, the reduced size of these tiny projectiles makes it very difficult to exert the full force of the cartridge powder charge effectively against the surface of the projectile. Furthermore the projectiles are usually fitted with protruding stabilizing surfaces such as fins or vanes, and for various reasons it has been difficult to fire these projectiles with a high degree of accuracy.

Therefore one of the principal objects of this invention is to provide a flechette cartridge with alignment means for the finned portion of the cartridge which can be accurately fired from a fully rifled barrel as well as from a smooth bore barrel.

Another object is to provide a flechette cartridge which can be positioned ready for firing in a rifled firearm barrel without the necessity of indexing the flechette fins against such barrel.

Still another object is to provide a flechette projectile against which the full force of the cartridge powder charge can be effectively applied. Other objects will be apparent from or will be indicated in the following discussion.

These objects have been accomplished in accordance with this invention. A segmented sabot flechette cartridge containing an internal needle-like finned projectile has been provided which can be fired from a rifled barrel without the necessity of first indexing the fins with respect to the rifling. The segmented sabot flechette unit is designed to proceed intact down a rifled barrel after being fired, and as the unit leaves the barrel, the sabot segments peel off allowing the flechette projectile to proceed accurately to the target. The novel cartridge of this invention can also be used in conjunction with a smooth bore barrel since the advantages of longitudinal alignment which are incorporated in this design are obtained in either type barrel. However it is desirable that the cartridge be used in a gun with a fully rifled barrel since the centrifugal force thus developed facilitates the removal of the sabot segments from the flechette.

Furthermore the unique cartridge described herein utilizes the sabot segments to increase the overall diameter of the sabot flechette unit to any desired point for more effective use of the cartridge powder gases. The built up surface area at the rear portion of the flechette-sabot segmented unit allows the expanding powder gases to exert a substantially increased pushing effect upon the entire projectile unit. Since the sabot segments can be prepared of relatively light weight material, this increased effectiveness of the powder charge can be utilized to propel the tiny finned flechette projectile at very high velocities.

The drawings contained herein should be considered in order to understand the nature of the invention. However it is to be understood that these drawings are illustrative only, and are not to be considered as limiting the scope of the invention described in this specification.

FIG. 1 is a cross-sectional view of a flechette projectile which is encompassed by segmented sabot particles.

FIG. 2 is a cross-sectional view of an individual sabot segment before it has been engraved by the rifling in a firearm barrel.

FIG. 3 is a side sectional view of a sabot segmented flechette projectile including a view of a wad and disk in the rear of said unit.

FIGS. 4 and 5 are additional side views of the front portion of a sabot segmented flechette projectile in which sabot segments of different shapes are employed.

FIG. 6 is a side sectional view of an entire cartridge designed in accordance with this invention.

Referring now to the drawings, FIG. 1 discloses a sabot having four segments 7 which intermesh with fins of a four finned flechette projectile 8. A flechette projectile 8 is encompassed by the sabot segments with the segments pictured as they are engraved by the rifling in a barrel.

In FIG. 3, a complete novel flechette cartridge is represented except for the outer cartridge casing and the cartridge powder charge. Immediately behind the flechette-sabot segmented unit is positioned a strong wad or disk 9 to propel the projectile unit ahead of the powder gases. A gas sealing wad 10 is also illustrated in this figure.

Alternatively shaped sabot segments are represented in FIGS. 4 and 5 as *7a* and *7b*.

In FIG. 6, the powder charge 11 and primer 12 are illustrated as they are positioned with relation to the projectile and the external cartridge casing 13.

The operation of the novel cartridge of this invention in a rifled barrel proceeds as follows. As the cartridge powder is ignited, the expanding powder gases are transmitted by the disk or wad 9 immediately behind the flechette-sabot segmented unit to the unit itself. As the projectile unit proceeds down the rifled barrel, spin is imparted to the unit, and the sabot segments are stripped from the flechette projectile by centrifugal force as the unit leaves the barrel of the firearm. The spin imparted to the flechette projectile also eliminates the tendency of such projectile to yaw in its flight toward the target. The quick removal of the sabot segments from the projectile is also an important aid to accuracy since the possibility of such segments impeding the flight of the projectile is greatly reduced. Furthermore, the rapid effective stripping of the sabot segments is an important improvement in the safety field, since sabot segments themselves could inflict serious wounds if improperly directed.

Positive axial alignment of the flechette projectile in the barrel of the firearm can be obtained by making the sabot segments of such dimensions that the flechette-sabot segmented unit has an axial length greater than the corresponding flechette fin length. In this way, the complete projectile unit does not undergo misalignment during bore travel with resulting loss of accuracy.

Obviously, the flechette projectiles which can be used in accordance with this invention may contain a varying number of fins or vanes. The number of sabot segments associated with such projectiles will also vary of course according to the number of fins utilized.

There are other advantages associated with the use of these novel cartridges. One of the primary advantages is that finned flechette projectiles can be readily fired automatically or semi-automatically since there is no need to index the fins with respect to the rifling in the barrel before each firing.

Another advantage obtained from this invention is that a low shear strength material may be used for the sabot segments because of the large shear area of contact between the fins and segments. For best results, the segments should preferably be made of a light material possessing good lubricity such as nylon or other similar materials.

Again the use of light weight material in the sabot segments is an important safety consideration since this helps to minimize the potential hazard associated with the sabot segments after launching of the flechette.

An obturating pad has been provided in the novel cartridge to prevent gas leakage past the thrust transmitting wad. A cup wad or a polyethylene or other suitable plastic wad can be utilized for this purpose.

What is claimed is:

1. A flechette cartridge comprising an external cartridge casing, an internal flechette projectile having protruding stabilizing surfaces, a plurality of individual sabot segments encompassing said projectile and intermeshing with the said protruding stabilizing surfaces to align said projectile with the bore of the firearm in which said cartridge is fired, said projectile-sabot segmented unit having an axial length greater than the axial length of the protruding stabilizing surfaces on said projectile thus supporting the forward portion of the projectile against buckling as the unit proceeds down the bore of the firearm, said sabot segments when intermeshed with said projectile forming a circle of diameter equal to or greater than the diametric circle encompassing the said protruding stabilizing surfaces, explosive means to propel said projectile and suitable means to support said projectile and segmented sabots against thrust of the powder gases and to obturate said powder gases.

2. The cartridge of claim 1 wherein the projectile and segmented sabots are supported against thrust of the powder gases by a suitably strong disk of bore diameter and wherein said disk is obturated against powder by a cup wad with rearwardly exposed cup.

3. The cartridge of claim 1 wherein the flechette projectile is a needle-like finned object.

4. The cartridge of claim 1 wherein the sabot segments are constructed of a light material possessing good lubricity.

5. The cartridge of claim 1 wherein the sabot segments are constructed of nylon.

* * * * *

UNITED STATES PATENT OFFICE

CERTIFICATE OF CORRECTION

Patent No. 4,083,306 Dated April 11, 1978

Inventor(s) William B. Woodring

It is certified that error appears in the above-identified patent and that said Letters Patent are hereby corrected as shown below:

Col. 4, line 22, after the word "powder" please insert --gases--.

Signed and Sealed this

*Fourteenth* Day of *October 1980*

[SEAL]

*Attest:*

SIDNEY A. DIAMOND

*Attesting Officer*

*Commissioner of Patents and Trademarks*